US010329963B2

(12) United States Patent
Altherr

(10) Patent No.: US 10,329,963 B2
(45) Date of Patent: Jun. 25, 2019

(54) VALVE TRAIN FOR AN INTERNAL COMBUSTION ENGINE

(71) Applicant: Mahle International GmbH, Stuttgart (DE)

(72) Inventor: Patrick Altherr, Stuttgart (DE)

(73) Assignee: Mahle International GmbH (DE)

( * ) Notice: Subject to any disclaimer, the term of this patent is extended or adjusted under 35 U.S.C. 154(b) by 129 days.

(21) Appl. No.: 15/466,850

(22) Filed: Mar. 22, 2017

(65) Prior Publication Data

US 2017/0276027 A1 Sep. 28, 2017

(30) Foreign Application Priority Data

Mar. 23, 2016 (DE) ..... 10 2016 204 889

(51) Int. Cl.

| | |
|---|---|
| ***F01L 1/34*** | (2006.01) |
| ***F01L 1/08*** | (2006.01) |
| ***F01L 1/047*** | (2006.01) |
| ***F01L 1/22*** | (2006.01) |
| ***F01L 1/053*** | (2006.01) |
| ***F01L 1/18*** | (2006.01) |
| ***F01L 13/00*** | (2006.01) |

(52) U.S. Cl.

CPC ..... *F01L 1/08* (2013.01); *F01L 1/047* (2013.01); *F01L 1/053* (2013.01); *F01L 1/18* (2013.01); *F01L 1/22* (2013.01); *F01L 13/0036* (2013.01); *F01L 2013/0052* (2013.01); *F01L 2013/101* (2013.01); *F01L 2105/00* (2013.01)

(58) Field of Classification Search

CPC ..... F01L 1/047; F01L 1/08; F01L 1/22; F01L 1/053; F01L 1/18; F01L 13/0036; F01L 2013/101; F01L 2013/0052; F01L 2105/00

See application file for complete search history.

(56) References Cited

U.S. PATENT DOCUMENTS

2010/0242874 A1 9/2010 Nakashima et al.

FOREIGN PATENT DOCUMENTS

| | | | |
|---|---|---|---|
| DE | 19945340 | A1 | 3/2001 |
| DE | 102010002495 | A1 | 11/2010 |
| DE | 102010012471 | A1 | 9/2011 |

(Continued)

OTHER PUBLICATIONS

European Search Report dated Sep. 14, 2017 relating to corresponding European Patent Application No. 17158220.8.

(Continued)

*Primary Examiner* — Zelalem Eshete

(74) *Attorney, Agent, or Firm* — Fishman Stewart PLLC

(57) ABSTRACT

A valve train for an internal combustion engine may include a camshaft and a cam follower. The valve train may also include two first cams arranged on the camshaft in a torque-proof manner and at an axial distance from one another. Each of the two first cams may include an identical first cam contour. The valve train may also include two second cams arranged on the camshaft in a torque-proof manner and at an axial distance from one another. Each of the two second cams may also include an identical second cam contour. The two first cams and the two second cams may alternate in an axial direction on the camshaft. The cam follower may be axially adjustable between a first and second position, and may be drivingly connected to the two first cams in the first position and drivingly connected to the two second cams in the second position.

20 Claims, 3 Drawing Sheets

(56) References Cited

FOREIGN PATENT DOCUMENTS

| | | | |
|---|---|---|---|
| DE | 102011004680 | A1 | 9/2011 |
| DE | 102010033089 | A1 | 2/2012 |
| DE | 102012101619 | A1 | 8/2013 |
| DE | 102014109243 | B3 | 11/2015 |
| JP | S60085205 | | 5/1985 |
| JP | S62711 | U | 1/1987 |
| JP | S62184115 | U | 11/1987 |
| JP | H5163971 | A | 6/1993 |
| JP | H0674011 | A | 3/1994 |
| JP | 2010249123 | A | 11/2010 |

OTHER PUBLICATIONS

English abstract for DE-19945340.
English abstract for DE-102010012471.
English abstract provided for DE-102010033089.
English abstract for DE-102014109243.
English abstract for JP-S60085205.

VALVE TRAIN FOR AN INTERNAL COMBUSTION ENGINE

CROSS-REFERENCE TO RELATED APPLICATIONS

This application claims priority to German Patent Application No. DE 10 2016 204 889.9, filed on Mar. 23, 2016, the contents of which are hereby incorporated by reference in its entirety.

BACKGROUND

By means of an adjustable, conventional valve train, which comprises two cams of different cam lift, the cylinder of an internal combustion engine can be operated in two different operating modes. If, instead of two cams of different lift only one single cam and—instead of a second cam—a base circle without cam lift is used, the cylinder can be shut off by means of the valve train. In such a shut off state, a cam follower, coupled to a gas exchange valve of the cylinder, does not interact with the single cam, but rather with said base circle, so that the gas exchange valve is not actuated.

A valve train of the type named in the introduction is known from DE 199 45 340 A1.

SUMMARY

It is an object of the present invention to indicate new ways in the development of valve trains.

This problem is solved by the subject of the independent claims. Preferred embodiments are the subject of the dependent claims.

The basic idea of the invention is, accordingly, to equip a valve train with at least two first and two second cams, which are arranged in axial direction of the camshaft alternately in a torque-proof manner on the latter. Here, the two first cams and the two second cams have a respectively identical cam contour. Such a "division" of a conventional, single first cam and of a conventional single second cam into respectively two first and two second cams has the result that the forces which are to be transferred from the cams to the cam follower can be distributed to the cam follower in a more homogeneous manner.

Furthermore, the shifting travel of the cam follower in the axial direction is shortened or respectively halved owing to the first and second cams arranged alternately in axial direction on the camshaft, during adjustment of the camshaft between a first and a second position. The cam follower rollers provided for adjusting the cam follower at the camshaft can also be constructed so as to be axially particularly short. Particularly in connection with the engine braking generated by an internal combustion engine with the valve train which is presented here, the higher forces, acting on the cam followers, can be received particularly well. As a result, this leads to a reduced mechanical wear in the valve train and therefore to an increased lifespan of the valve train.

A valve train according to the invention for an internal combustion engine comprises a camshaft and a cam follower. Two first cams, which according to the invention have an identical first cam contour, are arranged in a torque-proof manner and axially at a distance from one another on the camshaft. Two second cams, which according to the invention have an identical second cam contour, are arranged in a torque-proof manner and axially at a distance from one another on the shaft. The cam follower is axially adjustable between a first position, in which it is drivingly connected to the two first cams, and a second position, in which it is drivingly connected to the second cam. The cam follower according to the invention has, furthermore, a mechanical adjustment device, interacting with the camshaft, for the axial adjustment of the cam follower between the first and the second position.

In a preferred embodiment, the cam follower has a first and a second cam follower roller, arranged axially at a distance from one another, which in the first position interact with the two first cams and in the second position interacts with the two second cams. In this way, the shifting travel between it first and second position, necessary during the adjusting of the cam follower, in axial direction of the camshaft can be distinctly reduced with respect to conventional valve trains, ideally even halved.

Particularly preferably, in the first position of the cam follower respectively one of the two cam follower rollers is drivingly connected to respectively one of the two first cams. In the second position of the cam follower, on the other hand, respectively one of the two cam follower rollers is drivingly connected to respectively one of the two second cams. In this way, the forces which are to be transferred from the cams to the cam follower can be transferred particularly uniformly to the cam follower rollers of the cam follower, which has an advantageous effect on the wear of the cam follower rollers.

Particularly expediently, the two cam follower rollers are arranged at the same axial distance from one another as the two first cams from one another and as the two second cams. This provision ensures an effective drive coupling of the two first and second cams to the two cam follower rollers.

In an advantageous further development, at least two third cams and one third cam follower roller are present, which are constructed in the same manner as the first/second cams and as the first and the second cam follower roller. It is clear that in addition to two such third cams and a third cam follower roller, basically any desired number of cam pairs can be provided with cam contours respectively identical in pairs.

In another advantageous further development, which can be combined with the advantageous further development explained above, respectively at least three first cams, at least three second cams and at least three cam follower rollers are provided.

In a preferred embodiment, the mechanical adjustment device has an adjustable first mechanical engagement element. The latter interacts with a first slide guide present on the camshaft, for the axial adjusting of the cam follower from the first into the second position. The adjustment device also has a second mechanical engagement element which is able to be prepared, which for the axial adjusting of the cam follower from the second into the first position interacts with a second slide guide present on the camshaft. The use of such mechanical engagement elements allows technically complex pneumatic systems to be dispensed with.

In another preferred embodiment, the two slide guides are arranged axially adjustably relative to the camshaft on the latter and are connected to the cam follower by means of a coupling element. Said coupling is realized here such that an axial movement of the slide guides for adjusting between the first and second position is accompanied by an identical axial movement of the cam follower. This construction variant is accompanied by a particularly long lifespan of the mechanical adjustment device.

An advantageous further development proves to be particularly simple to realize technically, in which the two slide guides are constructed on a common sleeve. Said sleeve is pushed in an axially displaceable manner here onto the camshaft.

According to a particularly preferred embodiment, the coupling element engages into a recess provided on the sleeve. A variant is able to be realized in a technically particularly simple and therefore favourably priced manner, in which the recess, which is preferably realized as a circumferential groove formed on the outer circumference of the sleeve.

Particularly expediently, the coupling element can be constructed in a bolt-like or pin-like manner and can protrude radially outwards from the cam follower. This variant requires particularly little installation space.

In an alternative variant thereto, which requires particularly little installation space, a projection can protrude radially outwards from an outer circumferential side of the sleeve, which projection engages into a recess formed on the coupling element.

Particularly expediently, the projection can be constructed as a bead running around in circumferential direction of the sleeve.

According to a further embodiment, the mechanical adjustment device comprises a first actuator. By means of the first actuator, the first mechanical engagement element is adjustable between a first position, in which it engages into the first slide guide, and a second position, in which it does not engage into the first slide guide. Alternatively or additionally, the mechanical adjustment device comprises a second actuator, by means of which the second mechanical engagement element is adjustable between a first position, in which is engages into the second slide guide, and a second position, in which it does not engage into the second slide guide. The use of such actuators also allows pneumatic and/or hydraulic adjustment means, which are only able to be realized technically with considerable effort, to be dispensed with for adjusting the respective engagement element.

Expediently, the first actuator is adjustable between an inactive position and an active position. Preferably, the adjustability can be realized in such a way that the first actuator in the inactive position is out of contact with the first engagement element, and by an adjusting from the inactive position into the active position adjusts the first engagement element by mechanical contact from the second into the first position. In this variant, the second actuator can also be adjustable alternatively or additionally to the first actuator between an inactive position and an active position. Corresponding to the first actuator, the second actuator in the inactive position is also out of contact with the second engagement element. By an adjusting from the inactive position into the active position, the second actuator adjusts the second engagement element by mechanical contact from the second into the first position. The use of purely mechanical means—in the form of the actuators—for adjusting the engagement means simplifies the structure of the entire valve train. This involves considerable cost savings in the production of the valve train.

Expediently, the adjustment of the first and/or second engagement element from the first into the second position takes place by means of the stroke movement of the cam follower. In other words, the cam follower is moved by the stroke movement, brought about by the first or the second cam towards the two actuators. When these are situated in their active position, through the stroke movement of the cam follower and therefore of the respective engagement element, the respective engagement element is pressed against the respective fixed, therefore immovable actuator, in the active position with respect to the camshaft, and in this way is "displaced" by the actuator into its second position. An active adjusting of the first or second engagement element through an active movement of the first or respectively second actuator can in this way be dispensed with. Accordingly, the two actuators can be configured structurally in a very simple manner, which leads to cost advantages in production.

Particularly preferably, the two actuators can be constructed as linearly adjustable, electrically driven actuators. In this case, they can be actuated in a simple manner by a control device of the valve train for adjusting between the active position and the inactive position. Furthermore, the realization as electric actuators allows a very precise control of the linear positioning of the actuators along their adjustment direction. In this variant, the mechanical adjustment device is realized as an electromechanical adjustment device.

In a further preferred embodiment, the first actuator has a linearly adjustable first positioning element. The latter can comprise a cylindrical positioning body, the face side of which, on moving of the first engagement element into the first slide guide presses against a face side of the engagement element lying opposite the first positioning element. In an analogous manner, the second actuator can also have a linearly adjustable second positioning element, which has a cylindrical positioning body. Its face side, in an analogous manner to the first positioning element, on moving of the second engagement element into the second slide guide, can press against a face side of the second engagement element lying opposite the second positioning element. In the manner described above, the desired mechanical coupling of the actuator with the engagement element can be realised in a simple and therefore favourably priced manner.

In a further advantageous further development, the first actuator has a housing and a first positioning element which is adjustable relative to the housing in a translatory manner between the first and the second position. In this variant, the second actuator, alternatively or additionally to the first actuator, can also have a housing and a second positioning element which is adjustable relative to this housing in a translatory manner between the first and the second position. By means of such positioning elements, which preferably have a pin- or bolt-like contact section, the required mechanical interaction of the actuators with the engagement elements can be realized in a simple manner, in order to bring the engagement elements, preferably in a form-fitting manner, in engagement with the slide guides.

Expediently, the cam follower for at least one engagement element, preferably for both engagement elements, has an engagement element fixing device for the detachable fixing of the engagement element in the first or second position. In this variant, said engagement element fixing device has a spring-loaded fixing element. The latter, in the first position of the engagement element, is received in a first mount provided on the engagement element. In the second position of the engagement element, the fixing element is received in a second mount provided on the cam follower.

Preferably, the first and/or second engagement element have respectively a base body, constructed in a bolt-like or pin-like manner, on the circumferential side of which the first mount is constructed as a first circumferential groove, and the second mount is constructed as a second circumferential groove, arranged axially at a distance.

Particularly expediently, the mechanical adjustment device does not comprise any hydraulic and/or pneumatic components.

If the valve train is to be operated in an internal combustion engine with a cylinder which is able to be shut off, it is proposed according to a preferred embodiment to construct the first or second cam as a base circle without cam lift.

The invention further relates to an internal combustion engine with a previously presented valve train.

Further important features and advantages of the invention will emerge from the subclaims, from the drawings and from the associated figure description with the aid of the drawings.

It shall be understood that the features named above and to be explained further below are able to be used not only in the respectively indicated combination, but also in other combinations or in isolation, without departing from the scope of the present invention.

Preferred example embodiments of the invention are illustrated in the drawings and are explained in further detail in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
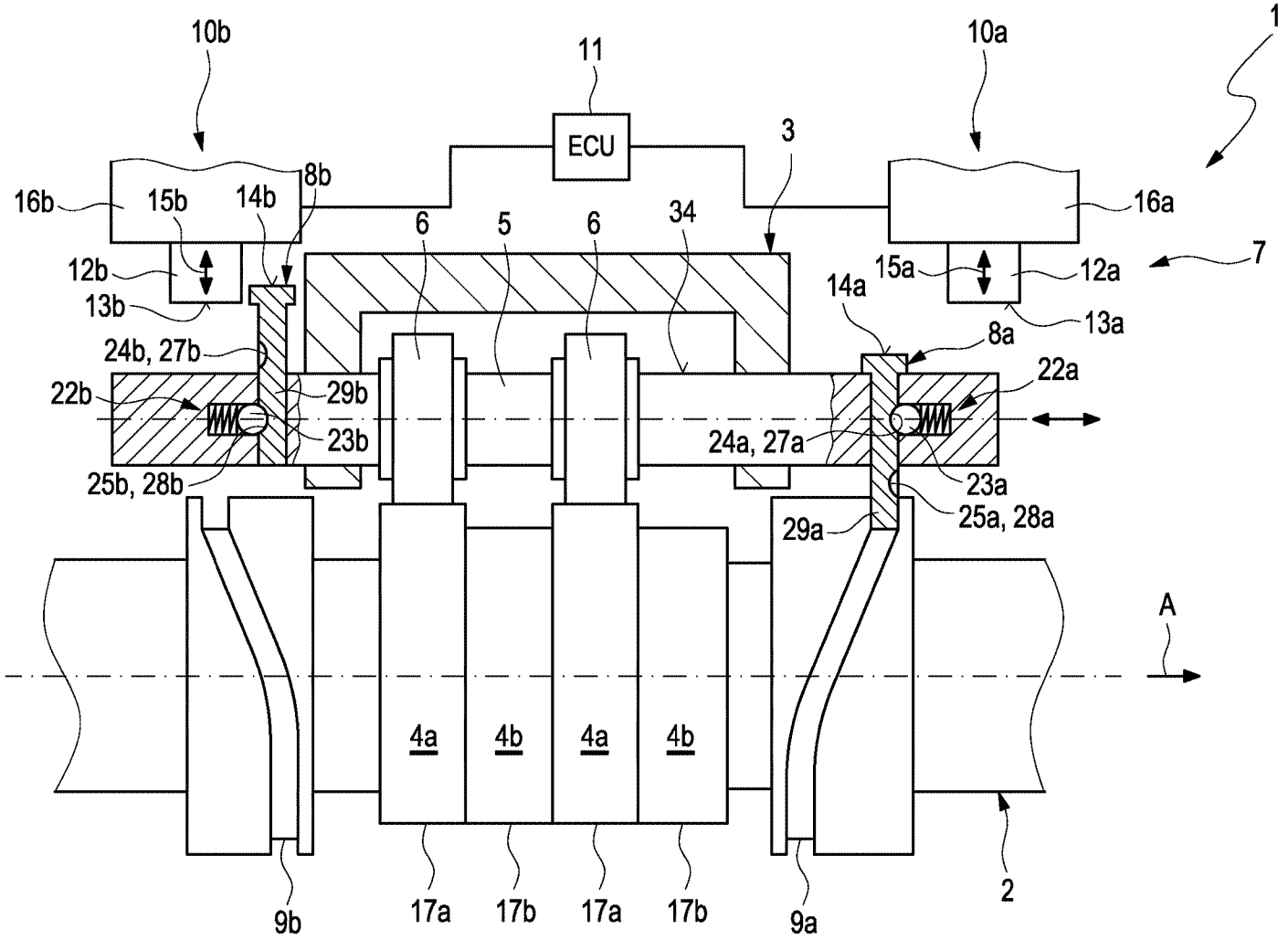
FIG. 1 an example of a valve train according to the invention, with a camshaft, FIG. 2 a variant of the example of FIG. 1, slide guides adjustable axially relative to the camshaft.

FIG. 1 illustrates in a diagrammatic illustration an example of a valve train 1 according to the invention. The valve train 1 comprises a camshaft 2 and a cam follower. On the camshaft 2, two first cams 4*a* are arranged, in a torque-proof manner and axially at a distance from one another, which have an identical first cam contour 17*a*. On the camshaft 2 furthermore, two second cams 4*b* are arranged, in a torque-proof manner and axially at a distance from one another, which have an identical first cam contour 17*b*. As FIG. 1 clearly shows, the two first cams 4*a* and the two second cams 4*b* alternate along the axial direction A of the camshaft 2.

The cam follower 3 is adjustable along an axial direction A between a first position, in which it is drivingly connected to the two first cams 4*a*, and a second position, in which it is drivingly connected to the two second cams 4*b*. FIG. 1 shows the cam follower 3 here in the first position.

The cam follower 3 can have a cylindrically constructed cam follower base body 5, on the circumferential side 34 of which at a distance from one another a first and a second cam follower roller 6, respectively constructed in a hollow-cylindrical manner, are rotatably mounted. The two cam follower rollers 6 are arranged at the same axial distance from one another as the two first cams 4*a* with respect to one another and as the two second cams 4*b* with respect to one another.

The cam follower base body 5 is also known to the relevant specialist in the art under the designation "bolt" or "displacement axis". Via the cam follower rollers 6, the drive connection or respectively mechanical coupling of the two first cams 4*a* with the two cam follower rollers 6 of the cam follower 3 takes place when the latter is connected in the first position. In the second position, the two cam follower rollers 6 are drivingly connected or respectively mechanically coupled with the two second cams 4*b*. In both cases, the rotational movement of the camshaft 2 is converted by means of the first or respectively second cams 4*a*, 4*b* into a linear movement of the cam follower 3.

In the first position of the cam follower 3, shown in FIG. 1, the two cam follower rollers 6 are therefore coupled to the first cam 4*a*, but not to the second cam 4*b*. The cam follower rollers 6 actuate via a suitably constructed mechanical coupling device (not illustrated in further detail in FIG. 1), in particular in the manner of an actuator, a valve for adjusting between an open and a closed state.

The cam follower 3 of FIG. 1 has a mechanical adjustment device 7, interacting with the camshaft 2, for the axial adjustment of the cam follower 3 between the first and the second position. The mechanical adjustment device 7 comprises, for this, a first adjustable mechanical engagement element 8*a*. The first mechanical engagement element 8*a* interacts, for the axial adjustment of the cam follower 3 from the first position shown in FIG. 1 into the second position, with a first slide guide 9*a* present on the camshaft 3. In an analogous manner, the mechanical adjustment device 7 has an adjustable second mechanical engagement element 8*b*. The second engagement element 8*b* interacts, for the axial adjustment of the cam follower 3 from its second position into the first position, with a second slide guide 9*b* present on the camshaft 3.

The mechanical adjustment device 7 further comprises a first actuator 10*a*, by means of which the first engagement element 8*a* is adjustable between a first position, shown in FIG. 1, in which it engages into the first slide guide 9*a*, and a second position, not shown in the figures, in which it does not engage into the first slide guide 9*a*. The mechanical adjustment device 7 also comprises a second actuator 10*b*, by means of which the second engagement element 8*b* is adjustable between a first position, in which it engages into the second slide guide 9*b*, and a second position, in which it does not engage into said second slide guide 9*b*. The mechanical adjustment device 7 does not comprise any hydraulic or pneumatic components.

The first actuator 10*a* is adjustable between an inactive position and an active position. For this purpose, the two actuators 10*a*, 10*b* can be constructed as linearly adjustable, electrically driven actuators. The mechanical adjustment device 7 is realized in this case as an electromechanical adjustment device. In other words, electrically driven actuators 10*a*, 10*b* are included here by the term "mechanical adjustment device" 7.

The two actuators 10*a*, 10*b* are controllable by a control device 11 of the valve train 1 for adjusting between their active position and their inactive position. This adjustability is realized in such a way that the first actuator 10*a* in the inactive position is out of contact with the first engagement element 8*a*. During an adjusting from its inactive position into its active position, the first actuator 10*a* adjusts the first engagement element 8*a* through mechanical contact form its second position into its first position.

The adjustment of the first engagement element 8*a* from the first into the second position can preferably be brought about by means of the stroke movement of the cam follower 3, in particular by means of the cam follower base body 5. Here, the cam follower 3 is moved by the stroke movement, brought about by the first or second cam 4*a*, 4*b*, in the direction of the first actuator 10*a*. If the latter is situated in its active position, then through the stroke movement of the cam follower 3 and therefore of the first engagement element 8*a*, the latter is pressed against the first actuator 10*a* and is adjusted by the latter into its second position. In this state, the first engagement element 8*a* engages into the first slide guide 9*a*, so that the cam follower 3, owing to the rotational movement of the camshaft 2, is moved by means of the first slide guide 9*a*, arranged thereon, axially from its first position into the second position. The second actuator 10*b* is also adjustable between an inactive position and an active position. This adjustability is realized in such a way that the second actuator 10*b* in the inactive position is out of contact with the second engagement element 8*b*. During an adjustment from its inactive position into its active position, the second actuator 10*b* adjusts the second engagement element 8*b*, through mechanical contact, from its second position into its first position.

The adjustment of the second engagement element 8*b* from the first position into the second position is preferably also brought about by means of the stroke movement of the cam follower 3, in particular by means of the cam follower base body 5. Here, the cam follower 3 is moved by the stroke movement, brought about by the first or second cam 4*a*, 4*b*, in the direction of the second actuator 8*b*. When the latter is situated in its active position, then through the stroke movement of the cam follower 3 and therefore of the second engagement element 8*b*, the latter is pressed against the second actuator 10*b* and is therefore adjusted by the latter into its second position.

In this state, the second engagement element 8*b* engages into the second slide guide 9*b*, so that the cam follower 3, owing to the rotational movement of the camshaft 2, is moved by means of the second slide guide 9*a*, arranged thereon, axially from its second position into the first position.

The first actuator 10*a* has a linearly adjustable (cf. arrow 15*a*) first positioning element 12*a*. The latter can project partially from a first housing 16*a* of the first actuator 10*a* and be arranged in a linearly adjustable manner relative thereto. A face side 13*a* of the first positioning element 12*a*, facing the first engagement element 8*a*, which first positioning element can be contrusted in a pin- or bolt-like manner, presses on moving of the first engagement element 8*a* into the first slide guide 9*a* against a face side 14*a* of the first engagement element 8*a* lying opposite the first positioning element 12*a*. The second actuator 10*b* has a linearly adjustable (cf. arrow 15*b*) second positioning element 12*b*. The latter can project partially from a second housing 16*b* of the second actuator 10*b* and be arranged in a linearly adjustable manner relative thereto. A face side 13*b* of the second positioning element 12*b*, facing the second engagement element 8*b*, which second positioning element can be constructed in a pin- or bolt-like manner, presses on moving of the second engagement element 8*b* into the second slide guide 9*b* against a face side 14*b* of the second engagement element 8*b* lying opposite the second positioning element 12*b*.

As FIG. 1 clearly shows, the cam follower 3 has for the two engagement elements 8*a*, 8*b*, preferably for both engagement elements 8*a*, 8*b*, respectively a first or respectively second engagement element fixing device 22*a*, 22*b* for the detachable fixing of the first or respectively second engagement element 8*a*, 8*b* in the first or second position. As can be seen, the two engagement element fixing devices 22*a*, 22*b* have respectively a spring-loaded fixing element 23*a*, 23*b* which in the first position of the respective engagement element 8*a*, 8*b* is received in a first mount 24*a*, 24*b* provided on the respective engagement element 8*a*, 8*b*. In the second position of the cam follower, the fixing element 23*a*, 23*b* is received in a second mount 25*a*, 25*b* provided on the cam follower. The first and the second engagement element 8*a*, 8*b* have respectively a base body 29*a*, 29*b* constructed in a bolt-like or pin-like manner. On a circumferential side of the base body 29*a*, 29*b* the first mount 24*a*, 24*b* is constructed as first circumferential groove 27*a*, 27*b* and the second mount 25*a*, 25*b* as second circumferential groove 28*a*, 28*b* arranged axially at a distance on the circumferential side.

With the aid of the illustration of FIG. 1 the adjustment of the cam follower 3 from the first into the second position is explained below. In the scenario of FIG. 1, the cam follower 3 is situated in the first position, in which its cam follower roller 6 is drivingly connected to the first cam 4*a*.

If an adjustment of the cam follower 2 from its first into its second axial position is to take place, then the first engagement element 8*a* of the mechanical adjustment device 7, as shown in FIG. 1, is brought into engagement with the first slide guide 9*a*. This takes place by means of the first electrical actuator 10*a*.

Figure 2:
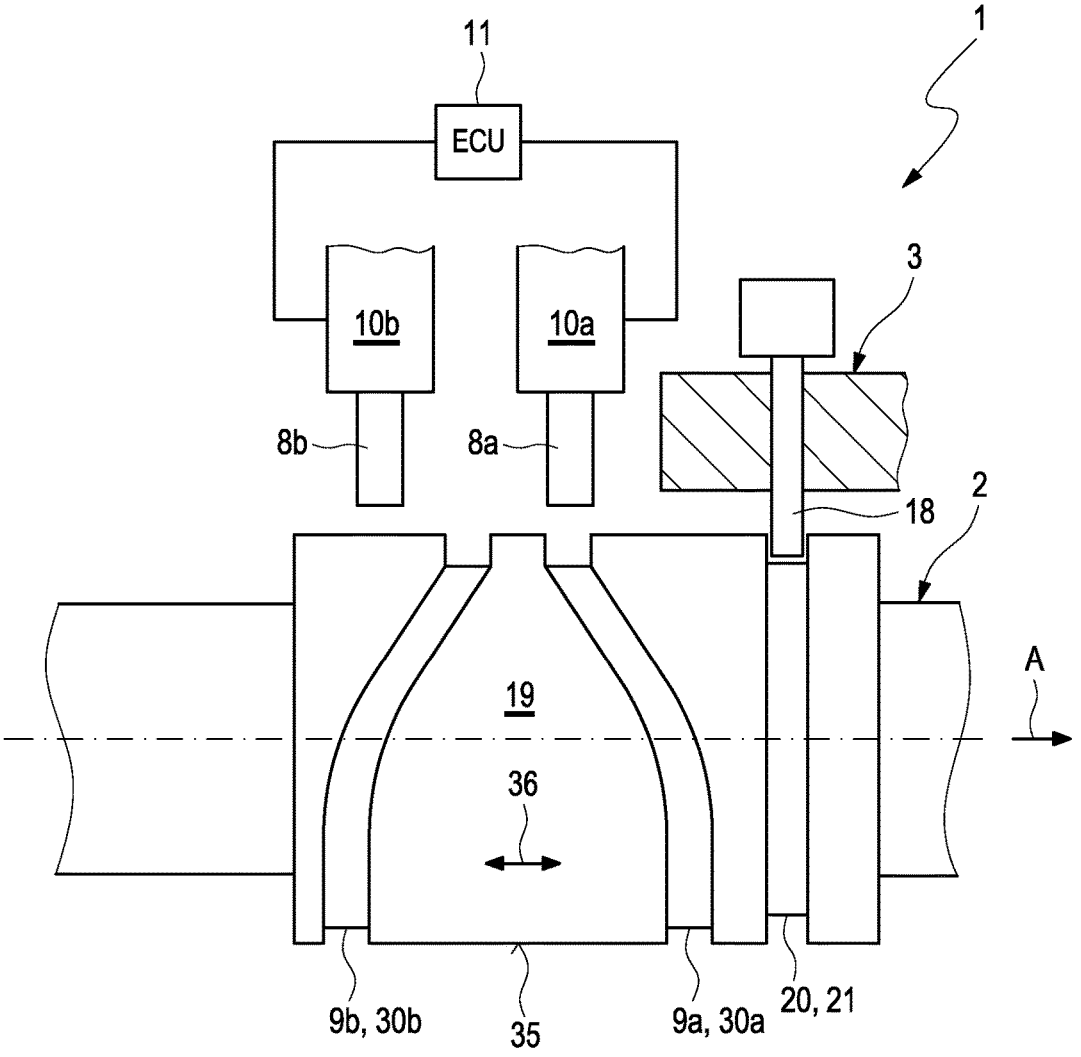

The first actuator 10*a*, as already explained, is adjustable between an inactive position, shown in FIG. 1, and an active position—indicated in dashed lines in FIG. 1. The first actuator 10*a* in the inactive position is mechanically out of contact with the first engagement element 8*a*. During an adjusting from its inactive position into its active position, the first actuator 10*a* adjusts the first engagement element 8*a* through mechanical contact from its second position into its first position. In the first position, the first engagement element 8*a* engages into the first slide guide 9*a* (cf. FIG. 1), so that the cam follower 3 is moved through the rotational movement of the camshaft 2 by means of the first slide guide 9*a* axially from its first position into its second position, which is illustrated in FIG. 2. After the bringing into engagement of the first engagement element 8*a* with the first slide guide 9*a*, the first actuator 10*a* can be moved back by the control device 11 into its inactive position again.

The first slide guide 9*a* can—just as the second slide guide 9*b*—have a ramp structure, which is not shown in the figures, such that the first engagement element 8*a* is brought out of engagement with the first slide guide as soon as the cam follower 3 has reached the second axial position. In this second position, the second cam 4*b* is in driving connection with the cam follower roller 6. The adjusting of the cam follower 3 from the second position back into the first position can take place by means of the second actuator 10*b*, of the second engagement element 8*b* and of the second slide guide 9*b* in an analogous manner to the previously explained transition from the first position into the second position of the cam follower 3.

In FIG. 2 a variant of the example of FIG. 1 is shown, wherein in FIG. 2 the camshaft 2 and the cam follower 3 of the valve train are shown only in an axial partial detail. In the variant according to FIG. 2, the two slide guides 9*a*, 9*b* are arranged relative to the camshaft 2 axially adjustably on the latter and are coupled to the cam follower 3 by means of a coupling element 18. Said mechanical coupling is realized here such that a movement of the slide guides 9*a*, 9*b* along the axial direction A—typically for adjustment of the cam follower 3 between the first and second position—is also accompanied by a movement of the cam follower 3 along the axial direction A. The coupling element 18, as shown in FIG. 2, is preferably constructed in a bolt-like or pin-like manner and can project radially outwards from the cam follower 3.

As FIG. 2 shows, the two slide guides 9*a*, 9*b* are formed as outer circumferential grooves 30*a*, 30*b* on a common sleeve 19. Said sleeve 19 is pushed here in an axially displaceable manner (cf. arrow 20) onto the camshaft 2.

Therefore, the coupling element 18 can engage, for mechanical axial coupling, into a recess 20 provided on the sleeve 19, which recess is realized according to FIG. 2 preferably as a circumferential groove 21 formed on the outer circumference of the sleeve 19.

On a movement of the sleeve 19 relative to the camshaft 2 along the axial direction A, brought about by an engagement of the first positioning element 8*a* or of the second positioning element 8*b* into the respective slide guide 9*a*, 9*b*, the cam follower 3—owing to the present mechanical coupling of the sleeve 19 via the coupling element 18—is entrained with the cam follower 3 in the axial direction A. In this way, the desired axial adjustment of the cam follower 3 is brought about between its first and its second position.

Figure 3:
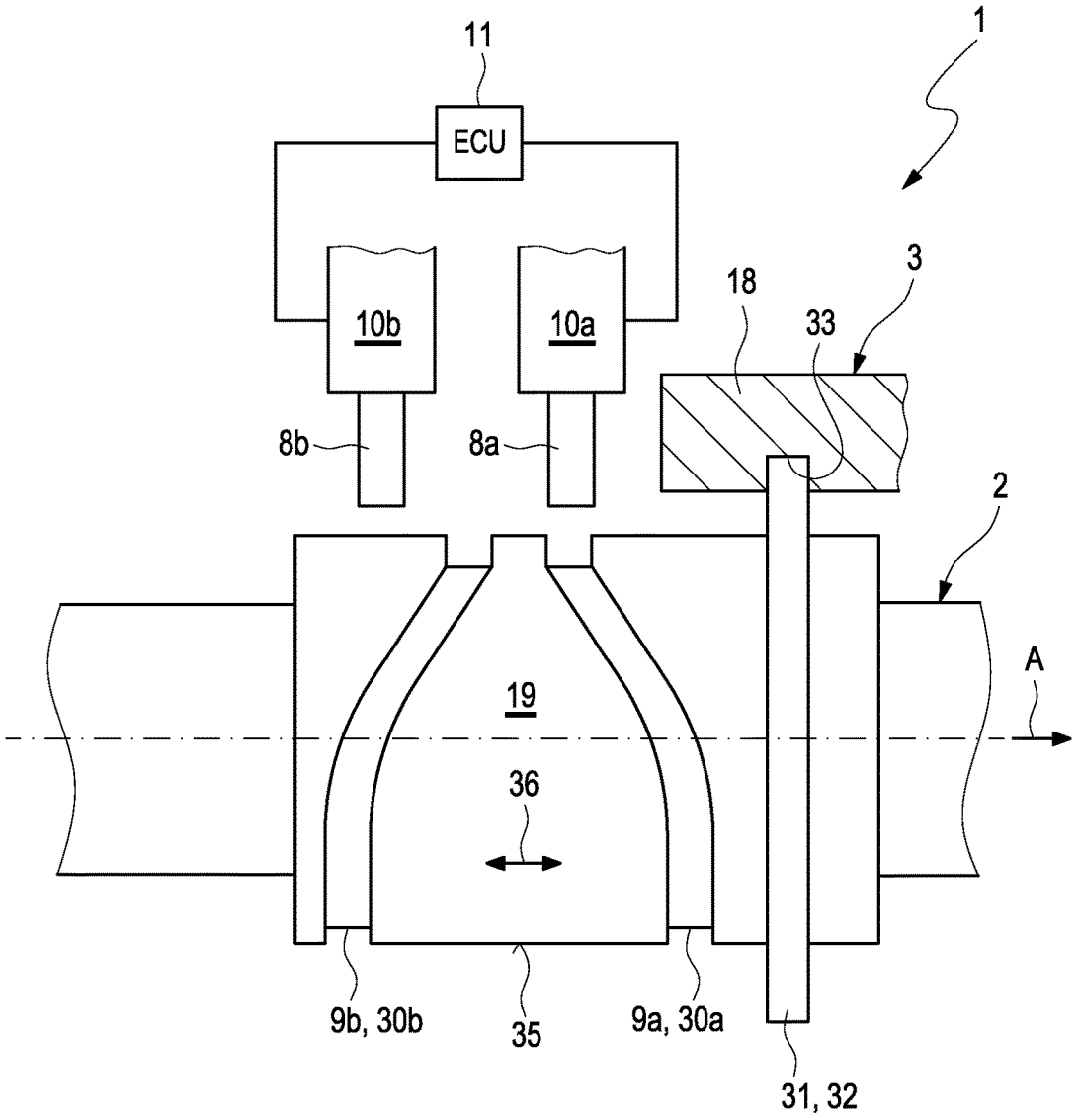
FIG. 3 an alternative variant of the example of FIG. 2.

FIG. 3 shows a variant of the example of FIG. 2. Also in the example of FIG. 3 the camshaft 2 and the cam follower 3 of the valve train are shown only in an axial partial detail. The example of FIG. 3 differs from that of FIG. 2 in that instead of the recess 20 provided on the sleeve 19, a projection 31 is provided, projecting radially outwards from the outer circumferential side 35 of the sleeve 19. The projection 31 can be constructed as a bead 32, running around in circumferential direction of the sleeve 19. The bead 32 or respectively the projection 31 engages into a recess 33 formed on the coupling element 18, which recess is preferably constructed in a groove-like manner. Said recess 33 can also be formed directly on the cam follower 3 or respectively on its cam follower base body (not shown in FIG. 3). The operating principle of projection 31 and recess 33 in the variant of FIG. 3 corresponds to the operating principle of the bolt-like coupling element 18 in connection with the recess 20 formed on the sleeve 19.

The invention claimed is:

1. A valve train for an internal combustion engine, comprising:

a camshaft and a cam follower;

two first cams arranged on the camshaft in a torque-proof manner and at an axial distance from one another, each of the two first cams including an identical first cam contour; and two second cams arranged on the camshaft in a torque-proof manner and at an axial distance from one another, each of the two second cams including an identical second cam contour;

wherein the two first cams and the two second cams alternate in an axial direction on the camshaft such that adjacent cams of the two first cams and the two second cams axially contact each other;

wherein the cam follower is axially adjustable between a first position and a second position, the cam follower being drivingly connected to the two first cams in the first position, and drivingly connected to the two second cams in the second position; and wherein the cam follower includes a mechanical adjustment device configured to interact with the camshaft to axially adjust the cam follower between the first position and the second position.

2. The valve train according to claim 1, wherein:

the cam follower includes a first cam follower roller and a second cam follower roller arranged at an axial distance from one another; and wherein the cam follower rollers are coupled to the two first cams in the first position and coupled to the two second cams in the second position.

3. The valve train according to claim 2, wherein:

one of the cam follower rollers is drivingly connected to one of the two first cams when the cam follower is in the first position; and one of the cam follower rollers is drivingly connected to one of the two second cams when the cam follower is in the second position.

4. The valve train according to claim 2, wherein the axial distance between the two cam follower rollers, the axial distance between the two first cams and the axial distance between the two second cams are the same.

5. The valve train according to claim 2, further comprising at least two third cams arranged on the camshaft in a torque-proof manner and at an axial distance from one another, each of the at least two third cams including an identical third cam contour, wherein the cam follower includes a third cam follower roller.

6. The valve train according to claim 1, wherein:

the camshaft includes a first slide guide and a second slide guide;

the mechanical adjustment device includes an adjustable first mechanical engagement element configured to interact with the first slide guide when axially adjusting the cam follower from the first position to the second position; and the mechanical adjustment device includes an adjustable second mechanical engagement element configured to interact with the second slide guide when axially adjusting the cam follower from the second position to the first position.

7. The valve train according to claim 6, wherein the first slide guide and the second slide guide are arranged axially adjustable on the camshaft, and are coupled mechanically to the cam follower via a coupling, and wherein an axial movement of the first slide guide and the second slide guide is accompanied by an axial movement of the cam follower.

8. The valve train according to claim 6, wherein the first slide guide and the second slide guide are outer circumferential grooves arranged on a sleeve, the sleeve arranged on the camshaft in an axially displaceable manner.

9. The valve train according to claim 8, wherein the coupling engages a recess provided on the sleeve.

10. The valve train according to claim 7, wherein the coupling is constructed in a bolt-like or pin-like manner and projects radially outwards from the cam follower.

11. The valve train according to claim 8, further comprising a projection extending radially outwards from an outer circumferential side of the sleeve and configured to engage a recess on the coupling.

12. The valve train according to claim 11, wherein the projection is a bead extending around the sleeve in a circumferential direction.

13. The valve train according to claim 6, wherein at least one of:

the mechanical adjustment device includes a first actuator configured to adjust the first mechanical engagement element between a first position and a second position, the first mechanical engagement element configured to engage the first slide guide when in the first position and not engage the first slide guide when in the second position; and the mechanical adjustment device includes a second actuator, the second actuator configured to adjust the second mechanical engagement element between a first position and a second position, the second mechanical engagement element configured to engage the second slide guide when in the first position and not engage the second slide guide when in the second position.

14. The valve train according to claim 13, wherein the first actuator and the second actuator are linearly adjustable, electrically driven actuators controlled by an electronic control device.

15. The valve train according to claim 13, wherein:

the first actuator includes a linearly adjustable first positioning element, the first positioning element including a face side configured to contact a face side of the first mechanical engagement element lying opposite the first positioning element when the first mechanical engagement element is in the first position; and the second actuator includes a linearly adjustable second positioning element, the second positioning element including a face side configured to contact a face side of the second mechanical engagement element lying opposite the second positioning element when the second mechanical engagement element is in the first position.

16. The valve train according to claim 13, wherein:

the cam follower includes at least one engagement element fixing device configured to detachably fix at least one of the first mechanical engagement element and the second mechanical engagement element in the respective first position and the respective second position; and wherein the engagement element fixing device includes a spring-loaded fixing element corresponding to one of the first mechanical engagement element and the second mechanical engagement element, the spring-loaded fixing element received by a first mount provided on the corresponding engagement element when the corresponding engagement element is in the respective first position, and received by a second mount provided on the cam follower when the corresponding engagement element is in the respective second position.

17. The valve train according to claim 16, wherein:

at least one of the first mechanical engagement element and the second mechanical engagement element includes a base body constructed in one of a bolt-like manner and a pin-like manner;

the first mount is a circumferential groove arranged on a circumferential side of the base body; and the second mount is a circumferential groove arranged at an axial distance from the first mount.

18. The valve train according to claim 1, wherein the mechanical adjustment device does not include at least one of hydraulic components and pneumatic components.

19. An internal combustion engine, comprising a valve train, the vale train including:

a camshaft and a cam follower, the camshaft including a first slide guide and a second slide guide;

two first cams arranged on the camshaft in a torque-proof manner and at an axial distance from one another, each of the two first cams including an identical first cam contour; and two second cams arranged on the camshaft in a torque-proof manner and at an axial distance from one another, each of the two second cams including an identical second cam contour;

wherein the two first cams and the two second cams alternate in an axial direction on the camshaft;

wherein the cam follower is axially adjustable between a first position and a second position, the cam follower being drivingly connected to the two first cams in the first position, and drivingly connected to the two second cams in the second position;

wherein the cam follower includes a mechanical adjustment device configured to interact with the camshaft, the mechanical adjustment device facilitating the axial adjustment of the cam follower between the first position and the second position, the mechanical adjustment device including an adjustable first mechanical engagement element configured to interact with the first slide guide when axially adjusting the cam follower from the first position to the second position and an adjustable second mechanical engagement element configured to interact with the second slide guide when axially adjusting the cam follower from the second position to the first position; and wherein the first slide guide and the second slide guide are outer circumferential grooves arranged on a sleeve, the sleeve arranged on the camshaft in an axially displaceable manner.

20. A valve train for an internal combustion engine, comprising:

a camshaft and a cam follower, the camshaft including a first slide guide and a second slide guide;

two first cams arranged on the camshaft in a torque-proof manner and at an axial distance from one another, each of the two first cams including an identical first cam contour; and two second cams arranged on the camshaft in a torque-proof manner and at an axial distance from one another, each of the two second cams including an identical second cam contour;

wherein the two first cams and the two second cams alternate in an axial direction on the camshaft;

wherein the cam follower is axially adjustable between a first position and a second position, the cam follower being drivingly connected to the two first cams in the first position, and drivingly connected to the two second cams in the second position;

wherein the cam follower includes a mechanical adjustment device configured to interact with the camshaft to axially adjust the cam follower between the first position and the second position, the mechanical adjustment device including an adjustable first mechanical engagement element configured to interact with the first slide guide when axially adjusting the cam follower from the first position to the second position and an adjustable second mechanical engagement element configured to interact with the second slide guide when axially adjusting the cam follower from the second position to the first position; and wherein at least one of:

the mechanical adjustment device includes a first actuator configured to adjust the first mechanical engagement element between a first position and a second position, the first mechanical engagement element configured to engage the first slide guide when in the first position and not engage the first slide guide when in the second position; and the mechanical adjustment device includes a second actuator, the second actuator configured to adjust the second mechanical engagement element between a first position and a second position, the second mechanical engagement element configured to engage the second slide guide when in the first position and not engage the second slide guide when in the second position.

* * * * *